US008926278B2

(12) United States Patent
Chang et al.

(10) Patent No.: US 8,926,278 B2
(45) Date of Patent: Jan. 6, 2015

(54) FAN AND FAN FRAME THEREOF

(75) Inventors: Shun-Chen Chang, Taoyuan Hsien (TW); Shuo-Shiu Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1440 days.

(21) Appl. No.: 11/964,408

(22) Filed: Dec. 26, 2007

(65) Prior Publication Data

US 2008/0219837 A1 Sep. 11, 2008

(30) Foreign Application Priority Data

Mar. 6, 2007 (TW) ..... 96107617 A

(51) Int. Cl.
*F04B 39/12* (2006.01)
*F04D 25/06* (2006.01)
*F04D 29/54* (2006.01)

(52) U.S. Cl.
CPC ..... *F04D 25/0613* (2013.01); *F04D 29/542* (2013.01)
USPC ..... 415/219.1; 415/222; 417/424.2

(58) Field of Classification Search
USPC ..... 415/220, 219.1, 222; 361/695; 417/424.2
See application file for complete search history.

(56) References Cited

U.S. PATENT DOCUMENTS

| | | | | | |
|---|---|---|---|---|---|
| 856,115 | A * | 6/1907 | Wadagaki | 415/207 |
| 1,803,220 | A * | 4/1931 | Thompson | 415/220 |
| 2,788,172 | A * | 4/1957 | Stalker | 415/220 |
| 2,830,753 | A * | 4/1958 | Stalker | 415/222 |
| 2,936,948 | A * | 5/1960 | Eck | 415/218.1 |
| 2,952,403 | A * | 9/1960 | Stalker | 415/192 |
| 3,291,381 | A * | 12/1966 | Troller | 415/208.2 |
| 4,712,977 | A * | 12/1987 | Gerfast | 415/208.2 |
| 4,909,711 | A * | 3/1990 | Burgbacher et al. | 417/354 |
| 5,695,318 | A * | 12/1997 | Harmsen | 415/218.1 |
| 6,254,343 | B1 * | 7/2001 | Schmidt et al. | 415/222 |
| 6,746,205 | B2 * | 6/2004 | Huang et al. | 415/116 |
| 6,759,772 | B1 * | 7/2004 | Chang et al. | 310/67 R |
| 7,052,236 | B2 * | 5/2006 | Chang et al. | 415/191 |
| 7,234,919 | B2 * | 6/2007 | Lee et al. | 415/208.2 |
| 2004/0201961 | A1 * | 10/2004 | Ko et al. | 361/695 |
| 2004/0227422 | A1 * | 11/2004 | Chang et al. | 310/91 |
| 2005/0002784 | A1 * | 1/2005 | Li et al. | 415/220 |
| 2006/0039784 | A1 * | 2/2006 | Yan et al. | 415/220 |
| 2006/0042894 | A1 * | 3/2006 | Lee et al. | 188/267 |
| 2006/0233643 | A1 * | 10/2006 | Lin et al. | 415/220 |
| 2007/0065281 | A1 * | 3/2007 | Lan et al. | 415/220 |

* cited by examiner

*Primary Examiner* — Edward Look
*Assistant Examiner* — Aaron R Eastman
(74) *Attorney, Agent, or Firm* — Birch, Stewart, Kolasch & Birch, LLP

(57) ABSTRACT

A fan has a fan, an impeller and a motor. The impeller is disposed in the fan frame, and the motor is disposed in the fan frame for driving the impeller. The fan frame has a housing, a base and at least one connecting element. The housing has an inlet and an outlet, and the base is disposed in the housing and at the outlet. The connecting element is disposed between the housing and the base. The base has a first airflow guiding structure disposed on the circumference of the base. The housing has a second airflow guiding structure disposed on the inner circumference thereof and adjacent to the outlet. The first airflow guiding structure and the second airflow guiding structure are correspondingly disposed.

19 Claims, 2 Drawing Sheets

FAN AND FAN FRAME THEREOF

CROSS REFERENCE TO RELATED APPLICATIONS

This Non-provisional application claims priority under 35 U.S.C. §119(a) on Patent Application No(s). 096107617, filed in Taiwan, Republic of China on Mar. 6, 2007, the entire contents of which are hereby incorporated by reference.

BACKGROUND OF THE INVENTION

1. Field of Invention

The present invention relates to a fan and a fan frame thereof, and in particular to a fan and a fan frame thereof that can lower the noise and increase the efficiency.

2. Related Art

The efficiency of a fan is indicated by the air pressure and air volume that it can generate. To increase the air pressure and volume, one method is to increase its rotation speed. However, noises come with high-speed rotations. To solve this problem, the prior art modifies the design of blades. Nevertheless, this method is both difficult and impractical. In the overall structural design of the fan, changing the fan frame is another way of promoting the fan efficiency.

FIG. 1 is a cross-sectional view of a conventional fan 1, which has a fan frame 10. The fan frame 10 includes a housing 103, a base 104 and at least one connecting element 105 connecting the housing 103 and the base 104. The fan frame 10 also has an inlet 101 and an outlet 102. The base 104 is disposed at the outlet 102. The housing 103 has a first guiding angle 108 and a second guiding angle 109 at the inlet 101 and the outlet 102, respectively. The first guiding angle 108 and the second guiding angle 109 are slant surfaces for guiding the airflow in and out.

However, as the airflow is guided into the fan through the inlet 101, the airflow is directly guided out afterwards because the base 104 is a vertical structure. That is, the pressure of the airflow is not increased. Moreover, when the airflow passes by the outlet 102, the slant surface design of the second guiding angle 109 guides it out without any merging effect. After the airflow leaves the outlet 102, a vortex is produced at the outlet 102, which results in noises so that a negative effect on the efficiency of the fan is induced.

SUMMARY OF THE INVENTION

In view of the foregoing, the present invention is to provide a fan and a fan frame thereof. Through changes in the design of the fan frame and the airflow guiding structure on the base, the airflow speed can be increased to promote the air pressure and volume. Moreover, the present invention can prevent vortices from occurring at the outlet, so as to reduce noises during the fan operation.

To achieve the above, the present invention discloses a fan frame including a housing, a base and at least one connecting element. The housing has an inlet and an outlet, and the base is disposed at the outlet. The connecting element is disposed between the housing and the base. The base has a first airflow guiding structure disposed on the circumference of the base. The housing has a second airflow guiding structure disposed on the inner circumference of the housing and adjacent to the outlet. The first airflow guiding structure and the second airflow guiding structure are disposed correspondingly.

To achieve the above, the present invention also discloses a fan including a fan frame, an impeller and a motor. The fan frame includes a housing, a base and at least one connecting element. The housing has an inlet and an outlet, the base is disposed at the outlet, and the connecting element is disposed between the housing and the base. The base has a first airflow guiding structure disposed on the circumference of the base and adjacent to the outlet. The housing has a second airflow guiding structure disposed on the inner circumference of the housing and adjacent to the outlet. The first airflow guiding structure and the second airflow guiding structure are disposed correspondingly. The impeller and the motor are disposed in the fan frame, and the motor is for driving the impeller.

As mentioned above, in the present invention, the outgoing airflow can be converging by using the airflow guiding structures disposed on the base and the fan frame. Compared with the related art, the fan frame of the present invention can increase the speed of the airflow at the outlet, thereby increasing the air pressure and volume. Moreover, the present invention can prevent vortices from occurring at the outlet so as to reduce noises during the operation of the fan.

BRIEF DESCRIPTION OF THE DRAWINGS

The present invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
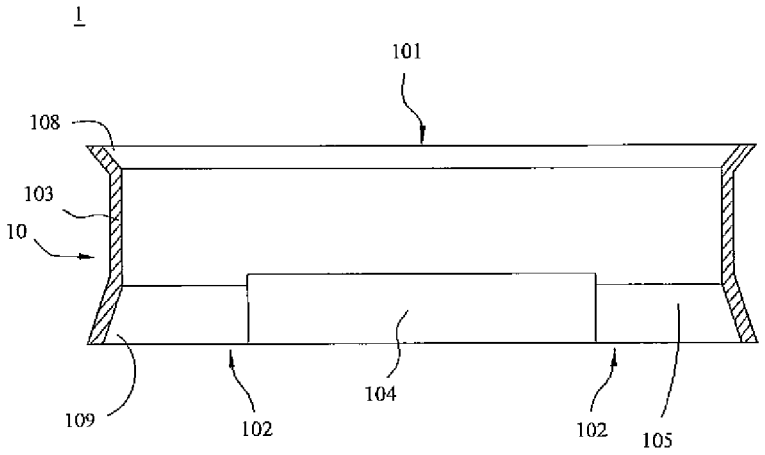
FIG. 1(PRIOR ART)
FIG. 1 is a cross-sectional view of a conventional fan.
Figure 2:
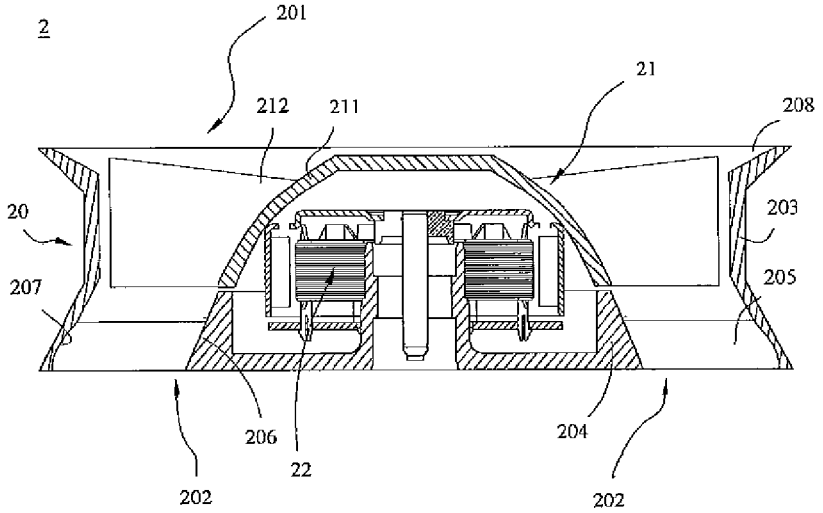
FIG. 2 is a cross-sectional view of a fan according to an embodiment of the present invention.

FIG. 2 is a cross-sectional view of a fan 2 according to an embodiment of the present invention. Referring to FIG. 2, the fan 2 of the embodiment is an axial-flow fan. The fan 2 includes a fan frame 20, an impeller 21 and a motor 22. The impeller 21 and the motor 22 are disposed in the fan frame 20. The fan frame 20 has a housing 203 with a through hole so as to form an inlet 201 and an outlet 202. The fan frame 20 has a roughly square, circular, elliptical or rhombus shape. Besides, the fan frame 20 includes a base 204 and at least one connecting element 205. The connecting element 205 is disposed between the housing 203 and the base 204 for supporting the base 204. In this embodiment, the connecting element 205 can be a rib or a stationary blade. The connecting element 205 can be integrally formed with the base 204 and the housing 203 as a single unit. The impeller 21 has a hub 211 and several blades 212 disposed around the hub 211. The outer radius of the hub 211 increases gradually from the inlet to the outlet. The motor 22 is disposed in the fan frame 20. The impeller 21 is disposed on the base 204 of the fan frame 20, and is driven by the motor 22.

With reference to FIG. 2, the base 204 includes a first airflow guiding structure 206. The base 204 is preferably disposed at the outlet 202. The first airflow guiding structure 206 is disposed on the circumference of the base 204 and adjacent to the outlet 202. The hub 211 has a curved or slant surface that corresponds to the profile of the first airflow guiding structure 206. The fan frame 20 has a second airflow guiding structure 207 disposed on the inner circumference of the housing 203 of the fan frame and adjacent to the outlet 202. In particular, the first airflow guiding structure 206 and the second airflow guiding structure 207 are disposed correspondingly and can be integrally formed with the base 204 and the housing 203, respectively.

It is noted that in order to increase the airflow speed and reduce the noise of the fan 2, the first airflow guiding structure 206 and second airflow guiding structure 207 have at least one slant surface and/or at least one curved surface. For example, the first airflow guiding structure 206 can include a single slant surface, a single curved surface, several slant surfaces, several curved surfaces, and/or their combinations. In this embodiment, the first airflow guiding structure 206 has a slant surface extending along the outlet 202 toward the housing 203. Therefore, when air flows through the first airflow guiding structure 206, it becomes a narrow stream due to the reduced channel. The second airflow guiding structure 207 has a curved surface with a curvature radius decreasing along the direction toward the outlet 202. A tangential direction of the curvature radius near the outlet 202 is about perpendicular to the outlet 202, so that the airflow does not expand.

In this embodiment, the fan frame 203 has a guiding angle 208 at the inlet 201. When the motor 22 operates to rotate the impeller 21, a pressure difference is produced between the fan 2 and the external environment because of the operation of the blades 212 on the hub 211. The airflow thus enters via the inlet 201 and is guided into the fan frame 20 by the guiding angle 208, flowing toward the outlet 202. When the airflow is guided by the guiding angle 208 into the fan frame 20 and passes by the first airflow guiding structure 206 and the second airflow guiding structure 207, the reduced airflow channel squeezes the airflow and accelerates its speed due to the design. At the same time, the airflow pressure increases. The curved-surface design of the second airflow guiding structure 207 changes the flowing direction of the airflow so that when the airflow leaves the outlet 202, the airflow direction is perpendicular to the outlet 202. This prevents vortices from occurring at the outlet 202 and helps reducing noises during the operation of the fan 2.

Figure 3:
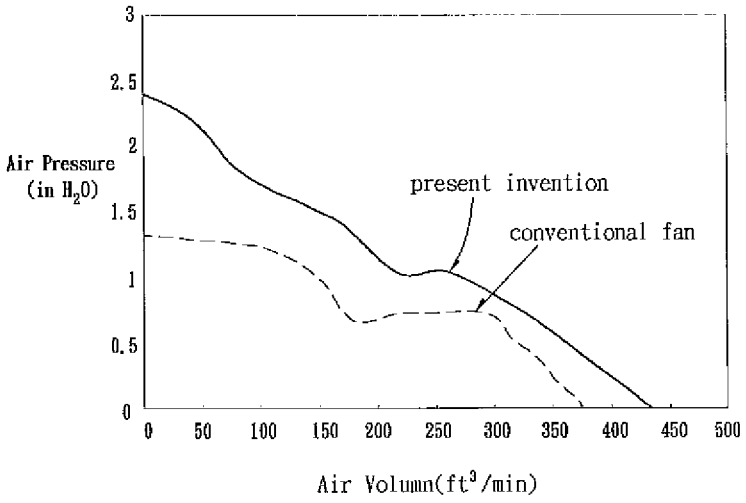
FIG. 3 shows the curves of the air volume and air pressure of the conventional fan and the fan of the present invention.

FIG. 3 shows the characteristic curve of the air pressure and air volume of the fan of the present invention compared with those of the conventional fan. Experimental data indicate that the fan of the present invention can effectively increase both the air pressure and volume. For example, at the same air volume, the maximum air pressure of the present invention is greater than that of the conventional fan by about 17%.

In summary, by using the airflow guiding structures disposed on the base and the fan frame, the outgoing airflow can be converging. Compared with the conventional fan, the fan frame of the present invention can increase the speed of the airflow at the outlet, thereby increasing the air pressure and volume. Moreover, the present invention can prevent vortices from occurring at the outlet, so as to reduce noises during the operation of the fan.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan frame applied to an impeller having a hub and several blades disposed around the hub, comprising:

a housing having an inlet and an outlet;

a base, disposed in the housing and at the outlet; and at least one connecting element disposed between the housing and the base;

wherein the base comprises a first airflow guiding structure disposed on a circumference of the base, the housing comprises a second airflow guiding structure disposed on an inner circumference of the housing and adjacent to the outlet, and the first airflow guiding structure and the second airflow guiding structure are disposed correspondingly, wherein the housing has a first extending portion, a second extending portion and a connecting portion, the first extending portion extends toward the inlet, the second extending portion extends toward the outlet, the connecting portion is connected to the first extending portion and the second extending portion, and the second airflow guiding structure is a recessed portion formed on an inner surface of the second extending portion.

2. The fan frame of claim 1, wherein the first airflow guiding structure and the base are integrally formed as a single unit.

3. The fan frame of claim 1, wherein the first airflow guiding structure comprises at least one slant surface and/or at least one curved surface.

4. The fan frame of claim 3, wherein the first airflow guiding structure extends along the outlet toward the housing.

5. The fan frame of claim 1, wherein the second airflow guiding structure and the housing are integrally formed as a single unit.

6. The fan frame of claim 1, wherein the connecting element, the base and the housing are integrally formed as a single unit, and the connecting element comprises a rib or a stationary blade.

7. The fan frame of claim 1, wherein the second airflow guiding structure comprises a curved surface.

8. The fan frame of claim 7, wherein a curvature radius of the curved surface decreases toward the outlet, and a line tangent to the curved surface near the outlet is about perpendicular to the outlet.

9. A fan, comprising:

a fan frame, comprising:

a housing having an inlet and an outlet, a base disposed in the housing and at the outlet, and at least one connecting element disposed between the housing and the base, wherein the base comprises a first airflow guiding structure disposed on a circumference of the base and adjacent to the outlet, so that an airflow channel decreases correspondingly, wherein the housing has a second airflow guiding structure disposed on an inner circumference of the housing, and the first airflow guiding structure and the second airflow guiding structure are disposed correspondingly;

an impeller disposed in the fan frame, and the impeller has a hub and several blades disposed around the hub; and a motor disposed in the fan frame for driving the impeller, wherein the housing has a first extending portion, a second extending portion and a connecting portion, the first extending portion extends toward the inlet, the second extending portion extends toward the outlet, the connecting portion is connected to the first extending portion and the second extending portion, and the second airflow guiding structure is a recessed portion formed on an inner surface of the second extending portion.

10. The fan of claim 9, wherein the first airflow guiding structure and the base are integrally formed as a single unit.

11. The fan of claim 9, wherein the first airflow guiding structure comprises at least one slant surface and/or at least one curved surface.

12. The fan of claim 9, wherein the first airflow guiding structure extends along the outlet toward the housing.

13. The fan of claim 9, wherein the second airflow guiding structure and the housing are integrally formed as a single unit.

14. The fan of claim 9, wherein a curvature radius of the curved surface decreases toward the outlet, and a line tangent to the curved surface near the outlet is about perpendicular to the outlet.

15. The fan of claim 9, wherein the connecting element, the base and the housing are integrally formed as a single unit, and the connecting element comprises a rib or a stationary blade.

16. The fan of claim 9, wherein the housing roughly has a square, circular, elliptical or rhombus shape, and the fan is an axial-flow fan.

17. The fan of claim 9, wherein the impeller comprises a hub and a plurality of blades disposed around the hub, and the hub has a curved or slant surface corresponding to a profile of the first airflow guiding structure.

18. The fan of claim 9, wherein the second airflow guiding structure comprises a curved surface.

19. A fan, comprising:

a fan frame, comprising:

a housing having an inlet and an outlet, a base disposed in the housing and at the outlet, and at least one connecting element disposed between the housing and the base, wherein the base comprises a first airflow guiding structure disposed on a circumference of the base and adjacent to the outlet so that an airflow channel decreases correspondingly;

an impeller disposed in the fan frame; and a motor disposed in the fan frame for driving the impeller, wherein the housing has a second airflow guiding structure disposed on an inner circumference of the housing and adjacent to the outlet, and the first airflow guiding structure and the second airflow guiding structure are disposed correspondingly, wherein the housing has a first extending portion, a second extending portion and a connecting portion, the first extending portion extends toward the inlet, the second extending portion extends toward the outlet, the connecting portion is connected to the first extending portion and the second extending portion, and the second airflow guiding structure is a recessed portion formed on an inner surface of the second extending portion.

* * * * *